US007371076B2

(12) United States Patent
Yen

(10) Patent No.: US 7,371,076 B2
(45) Date of Patent: May 13, 2008

(54) CHIP SOCKET STRUCTURE

(75) Inventor: Yu-Feng Yen, San Chung (TW)

(73) Assignee: A Point Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 11/497,419

(22) Filed: Aug. 2, 2006

(65) Prior Publication Data

US 2008/0032538 A1 Feb. 7, 2008

(51) Int. Cl.
*H01R 12/00* (2006.01)

(52) U.S. Cl. ..... 439/71

(58) Field of Classification Search ..... 439/71, 439/70, 66, 72, 862; 206/724; 174/541
See application file for complete search history.

(56) References Cited

U.S. PATENT DOCUMENTS 4,035,046 A * 7/1977 Kloth ..... 439/71
4,538,864 A * 9/1985 Ichimura ..... 439/69
5,073,116 A * 12/1991 Beck, Jr. ..... 439/71
6,964,573 B2 * 11/2005 Asai et al. ..... 439/71

* cited by examiner

*Primary Examiner*—Alexander Gilman
(74) *Attorney, Agent, or Firm*—Troxell Law Office, PLLC

(57) ABSTRACT

An improved structure of a chip socket is composed of a chip socket which is a square fixing seat, and a center of the fixing seat is provided with a cavity for holding a chip. Inner sides of the cavity are arranged with insertion slots for terminals, the cavity of fixing seat is provided with a fixing plate, and a side of the fixing plate is extended and arranged with insertion slots which are corresponding to pins of the terminals.

Through the correspondence of insertion slots of the fixing plate to the terminals at insertion slots, the pins of terminals can be tidily arranged inside the insertion slots, such that the pins can be maintained at a horizontal direction and there will be no void solder phenomenon caused by welding the pins, when the chip socket is welded with a surface mounting technology.

1 Claim, 6 Drawing Sheets

CHIP SOCKET STRUCTURE

BACKGROUND OF THE INVENTION a) Field of the Invention

The present invention relates to a chip socket structure, and more particularly to a chip socket structure wherein insertion slots of a fixing plate are corresponding to terminals, such that when pins of the terminals are correspondingly inserted into the insertion slots of fixing plate, they can be tidily arranged inside the insertion slots.

b) Description of the Prior Art

Referring to FIG. 1 and FIG. 2, a center of conventional chip socket A is provided with a cavity A2 for holding a chip A2, and peripheries of the cavity A2 are arranged with insertion slots A4 for terminals A3 which are connected with each pin A6 with connection plates A5. After the chip A2 is implanted, the connection plates A5 are broken off to separate the pins A6 from one another, and the pins A6 are extended in an approximately horizontal direction to form a suspension state at insertion parts A7. Therefore, after the chip socket A are assembled, the pins A6 are easy to form an irregular configuration, such that when a surface mounting technology is applied to weld the chip socket A on a circuit board, the pins A6 cannot be fixed horizontally and a void solder phenomenon is formed.

Accordingly, how to eliminate the aforementioned drawbacks is a technical issue to be solved by the inventor of present invention.

SUMMARY OF THE INVENTION

The present invention is to provide a chip socket structure, wherein insertion slots of a fixing plate are corresponding to terminals, such that when pins of the terminals are correspondingly inserted into the insertion slots of fixing plate, they can be tidily arranged inside the insertion slots; and upon welding the chip socket with a surface mounting technology, the terminals can be maintained at a horizontal direction, and there will be no void solder phenomenon resulted from welding the pins.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
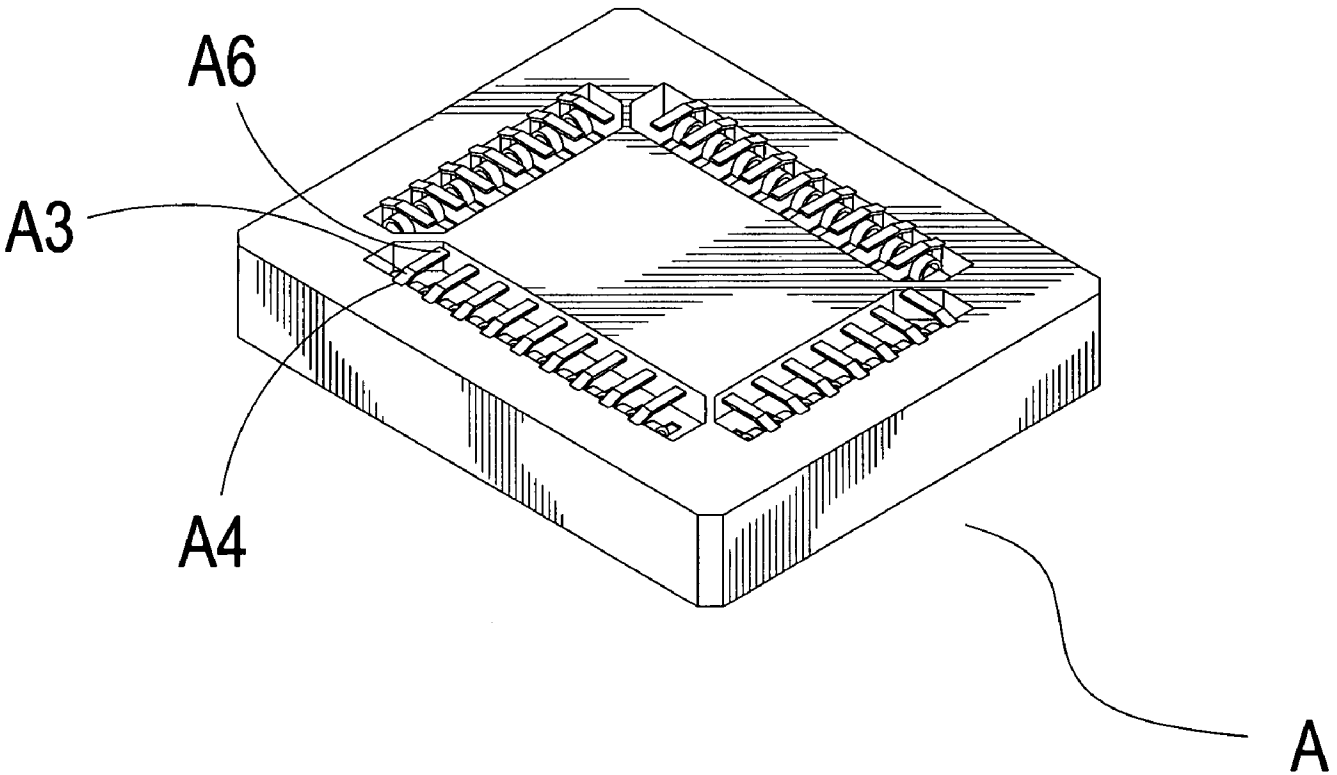
FIG.1 Prior Art
FIG. 1 shows a perspective view of a conventional chip socket.
Figure 2:
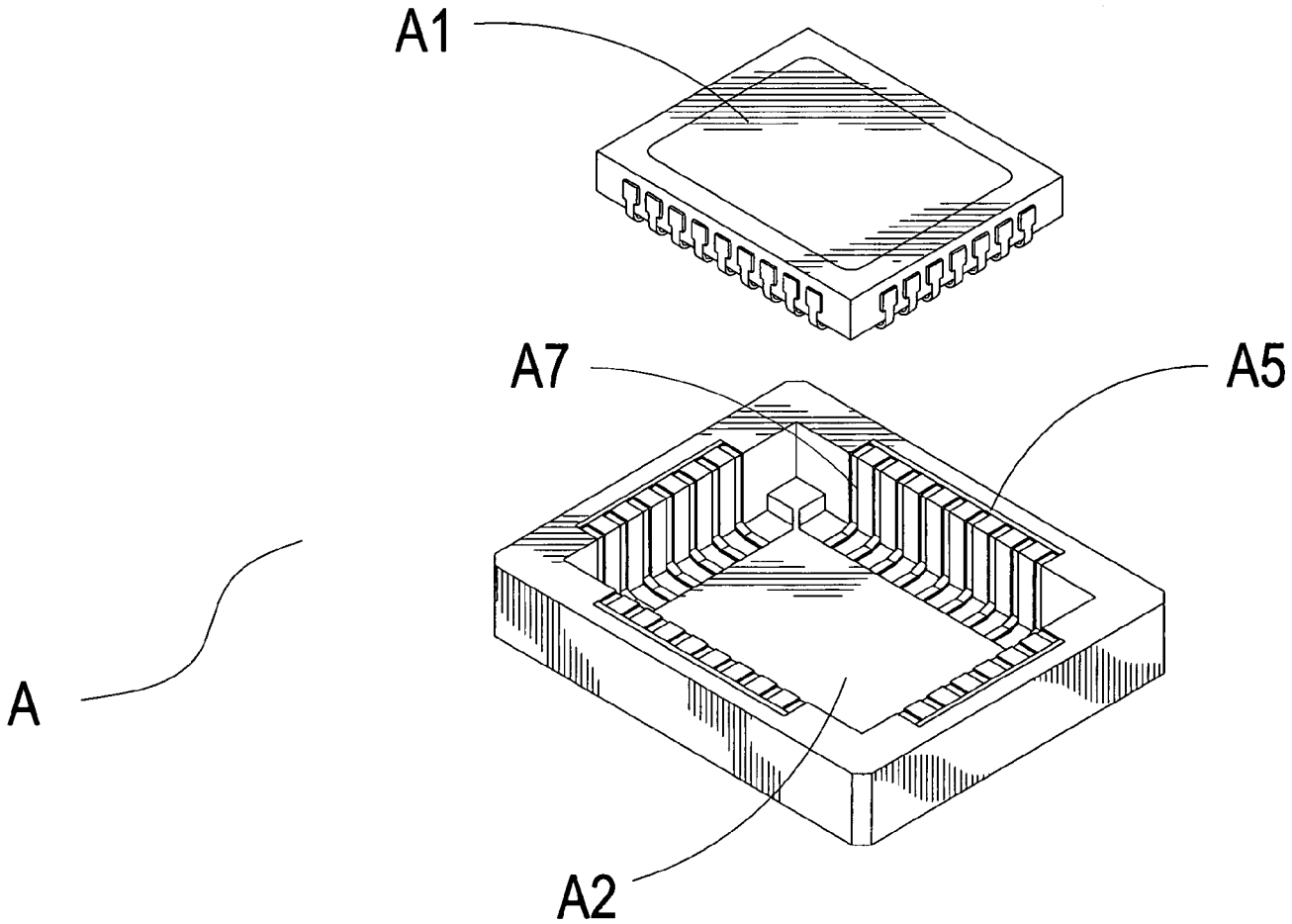
FIG.2 Prior Art
FIG. 2 shows a cutaway view of a conventional chip socket.
Figure 3:
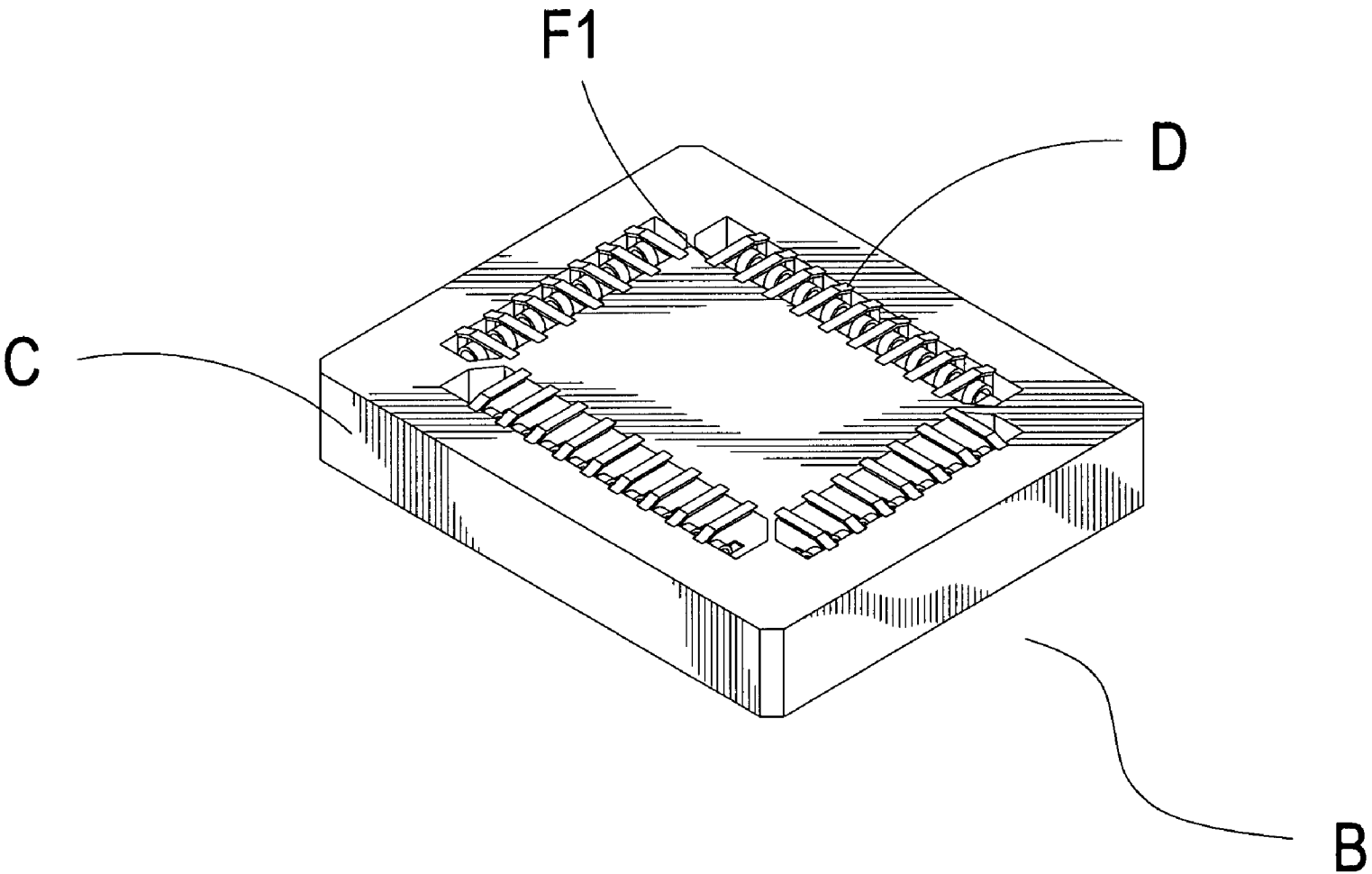
FIG. 3 shows a perspective view of the present invention.
Figure 4:
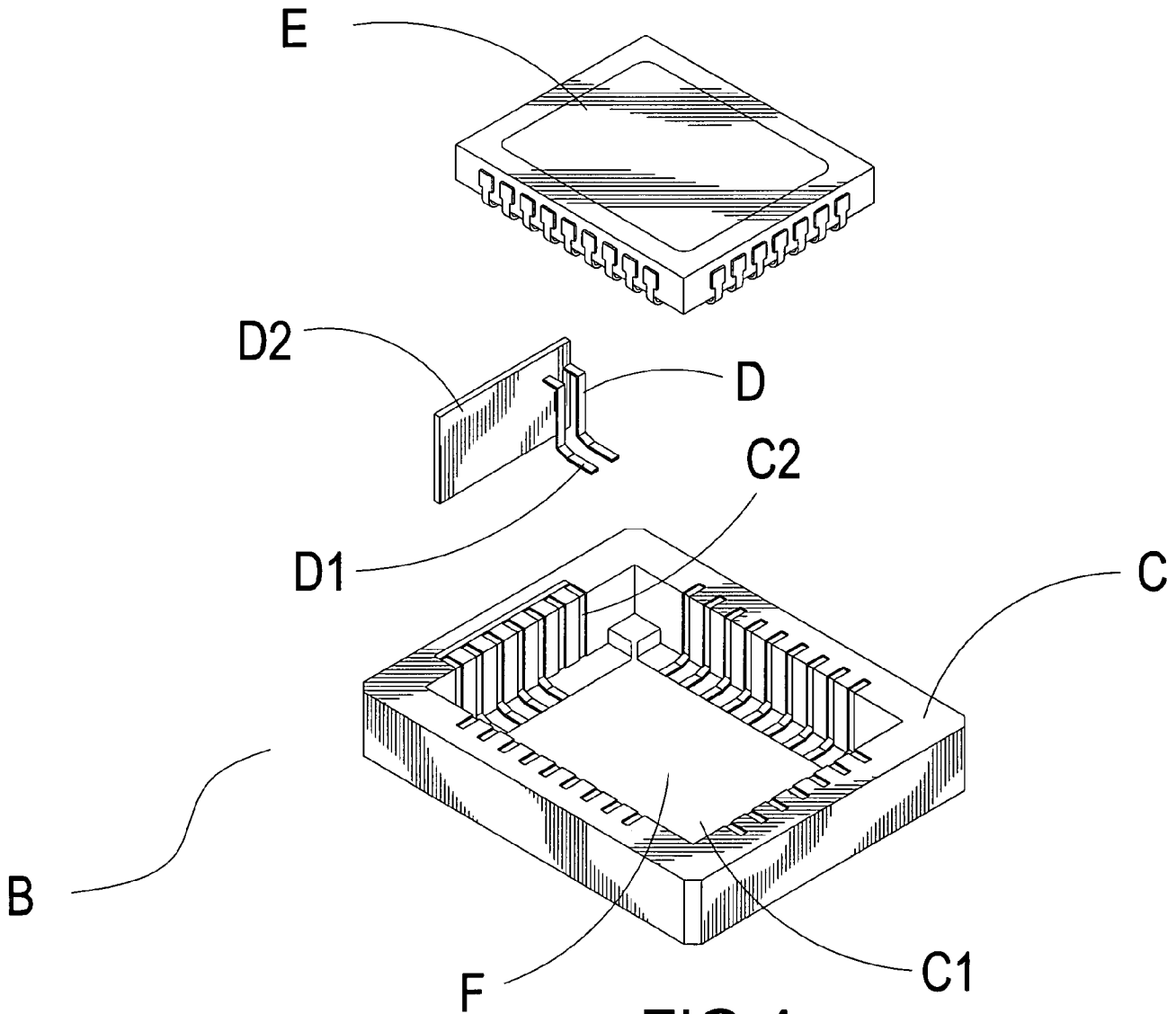
FIG. 4 shows an exploded view of the present invention.
Figure 5:
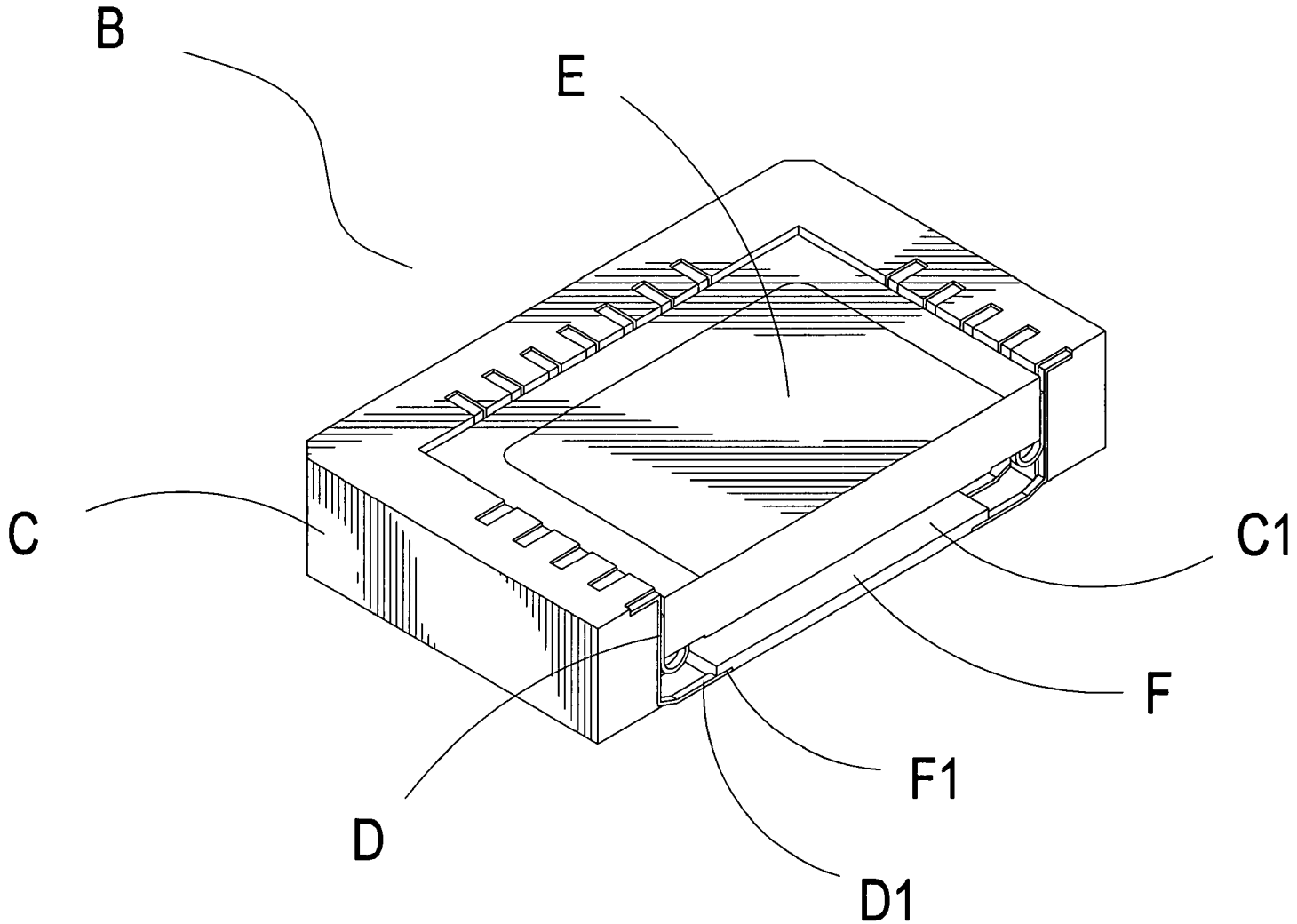
FIG. 5 shows a cutaway view of the present invention.

Referring to FIGS. 3 to 5, the present invention is to provide an improved structure of a chip socket, which comprises a chip socket B, a fixing seat C, terminals D, and a chip E.

The chip socket B is a square fixing seat C, and a center of which is provided with a cavity C1 for holding the chip E. Inner sides of the cavity C1 are arranged with insertion slots C2 for inserting the terminals D, and a side of the insertion slots C2 is extended with a fixing plate F which is corresponding to pins D1.

The terminals D of insertion slots C2 are connected to each pin D1 with connection plates D2, such that after the terminals D are inserted into the insertion slots C2 of fixing seat C, the connection plates D2 can be broken off to separate each pin D1 of terminals D from one another, thereby enabling the pins D1 to be correspondingly inserted into insertion slots F1 of the fixing plate F.

The pins D1 of terminals D are corresponding to the fixing plate F and the insertion slots F1 which are extended and arranged at a side of the fixing plate F. After the connection plates D2 and terminals D are inserted into the insertion slots C2 of fixing seat C, by using the insertion slots F1 of fixing plate F as a horizontal baseline, each pin D1 can be fixed without being adjusted and corrected, thereby achieving the objects of saving manpower and reducing production cost.

Accordingly, through the correspondence of insertion slots F1 of fixing plate F to the terminals D, the pins D1 of terminals D can be tidily arranged inside the insertion slots F1, such that when the chip socket B is welded with a surface mounting technology, the terminals D can be maintained at a horizontal direction and there will be no void solder phenomenon.

Figure 6:
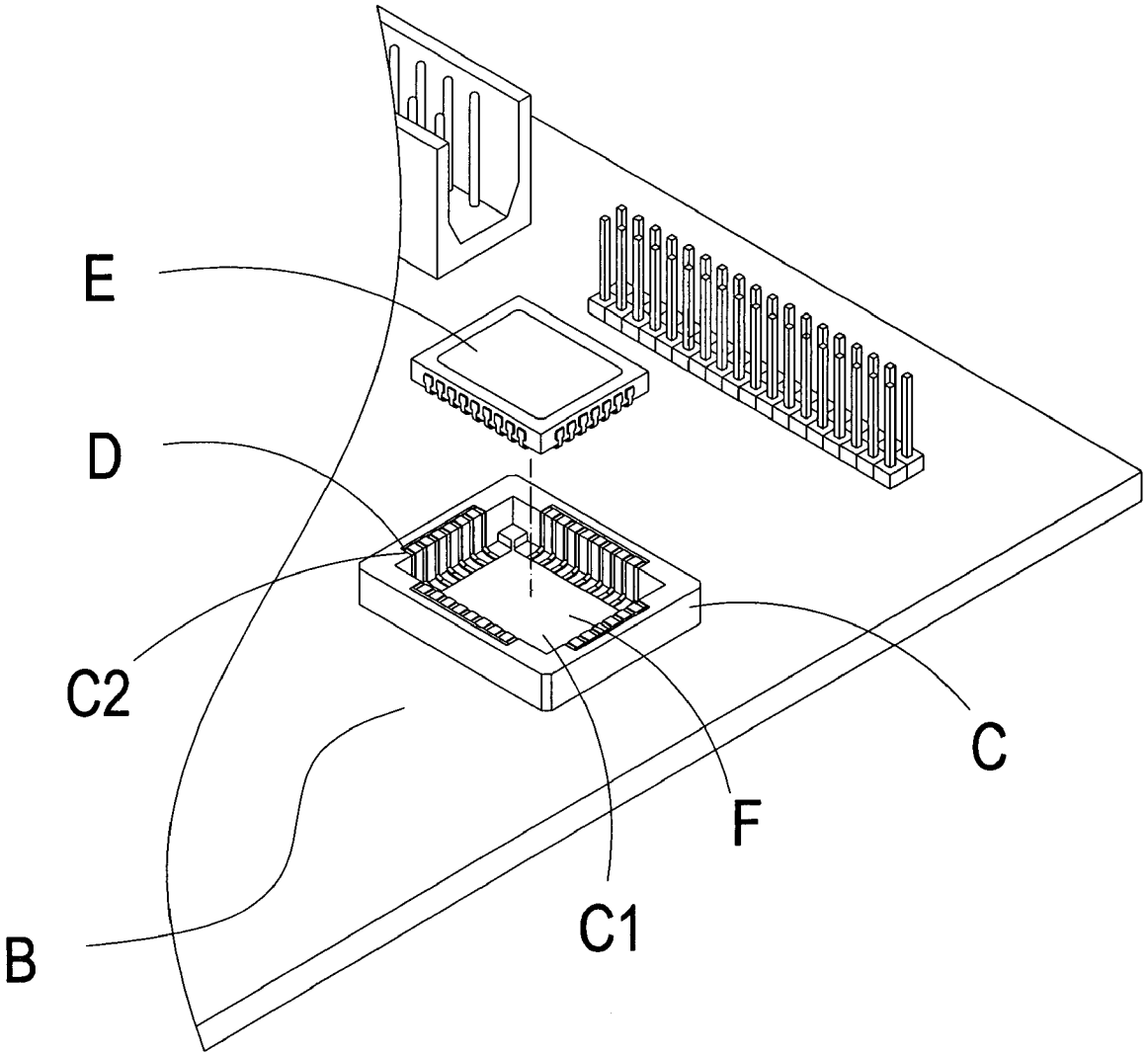
FIG. 6 shows a schematic view of an embodiment of the present invention.

Referring to FIGS. 4 to 6, the chip socket B is a square fixing seat C which is provided with a cavity C1 for holding the chip E. The cavity C1 is arranged with insertion slots C2 for inserting the terminals D, wherein the terminals D are connected to each pin D1 with connection plates D2. After the terminals D are inserted into the insertion slots C2 of fixing seat C, the connection plates D2 can be broken off to separate each pin D1 of terminals D from one another.

The pins D1 of terminals D are corresponding to the fixing plate F, and insertion slots F1 which are extended and arranged at a side of the fixing plate F. After the connection plates D2 and terminals D are inserted into the insertion slots C2 of fixing seat C, by using the insertion slots F1 of fixing plate F as a horizontal baseline, each pin D1 can be fixed without being adjusted and corrected, thereby achieving the objects of saving manpower and reducing production cost.

Moreover, a center of the fixing seat C is provided with the fixing plate F, and a side of the fixing plate F is provided with the insertion slots F1 which are corresponding to the terminals D. When the terminals D are inserted into the insertion slots C2 of fixing seat C, through the correspondence of insertion slots F1 of fixing plate F to the terminals D, the pins D1 of terminals D can be tidily arranged inside the insertion slots F1, such that the terminals D can be maintained at a horizontal direction and there will be no void solder phenomenon, in welding the chip socket B with the surface mounting technology.

To further manifest the advancement and practicability of the present invention, the present invention is compared with a conventional chip socket as below:

Shortcomings of a Conventional Chip Socket

1. The pins are configured in an approximately horizontal direction to form a suspension state, thereby being easy to result in an irregular configuration.
2. According to item 1, when the chip socket is welded on a circuit board, it is easy to result in a void solder phenomenon.

Advantages of the Present Invention

1. By using the insertion slots of fixing plate as a horizontal baseline, each pin can be fixed without being adjusted or corrected, thereby achieving the objects of saving manpower and reducing production cost.

2. Through the correspondence of insertion slots of fixing plate to the pins of terminals, the pins of terminals can be tidily arranged inside the insertion slots, thereby enabling the pins of terminals to achieve a best conducting effect.
3. Through the correspondence of insertion slots of fixing plate to the pins of terminals, the terminals can be maintained at a horizontal direction and there will be no void solder phenomenon when the chip socket is welded with the surface mounting technology.
4. It is provided with the advancement and practicability.
5. It is provided with an industrial competitiveness. It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A chip socket structure comprising a chip socket, a fixing seat, terminals, and a chip, wherein the chip socket is square on a plane projection, a center of the chip socket is provided with a cavity for holding the chip; inner sides of the cavity being arranged with insertion slots for inserting the terminals; the cavity of the fixing seat being provided with a fixing plate, an edge of the fixing plate having insertion slots corresponding to pins of the terminals so that the edge of the fixing plate overlaps the pins of the terminals, wherein through the correspondence of insertion slots of the fixing plate to the terminals at the insertion slots, the pins of the terminals being tidily arranged inside the insertion slots, such that the terminals are maintained at a horizontal direction and there will be no void solder phenomenon caused by welding the pins, when the chip socket is welded with a surface mounting technology.

* * * * *